US010283142B1

(12) United States Patent
Yu et al.

(10) Patent No.: US 10,283,142 B1
(45) Date of Patent: May 7, 2019

(54) PROCESSOR-IMPLEMENTED SYSTEMS AND METHODS FOR DETERMINING SOUND QUALITY

(71) Applicant: Educational Testing Service, Princeton, NJ (US)

(72) Inventors: Zhou Yu, Pittsburgh, PA (US); Vikram Ramanarayanan, San Francisco, CA (US); David Suendermann-Oeft, San Francisco, CA (US); Xinhao Wang, San Francisco, CA (US); Klaus Zechner, Princeton, NJ (US); Lei Chen, Lawrenceville, NJ (US); Jidong Tao, Lawrenceville, NJ (US); Yao Qian, San Francisco, CA (US)

(73) Assignee: Educational Testing Service, Princeton, NJ (US)

( * ) Notice: Subject to any disclaimer, the term of this patent is extended or adjusted under 35 U.S.C. 154(b) by 0 days.

(21) Appl. No.: 15/215,649

(22) Filed: Jul. 21, 2016

Related U.S. Application Data

(60) Provisional application No. 62/195,359, filed on Jul. 22, 2015.

(51) Int. Cl.

| | |
|---|---|
| ***G10L 25/30*** | (2013.01) |
| ***G10L 25/60*** | (2013.01) |
| ***G10L 25/24*** | (2013.01) |
| ***G10L 25/93*** | (2013.01) |

(52) U.S. Cl.
CPC ..... *G10L 25/60* (2013.01); *G10L 25/24* (2013.01); *G10L 25/30* (2013.01); *G10L 25/93* (2013.01)

(58) Field of Classification Search
CPC ..... G10L 25/30; G10L 25/60; G10L 25/16
See application file for complete search history.

(56) References Cited

U.S. PATENT DOCUMENTS

| | | | | |
|---|---|---|---|---|
| 9,489,864 | B2 * | 11/2016 | Evanini | G10L 25/60 |
| 9,514,109 | B2 * | 12/2016 | Yoon | G06F 17/24 |
| 2010/0145698 | A1 * | 6/2010 | Chen | G09B 7/02 704/256.1 |
| 2015/0248608 | A1 * | 9/2015 | Higgins | G06N 3/08 706/16 |

OTHER PUBLICATIONS

Hönig, Florian, et al. "Automatic modelling of depressed speech: relevant features and relevance of gender." Interspeech. 2014.*

(Continued)

*Primary Examiner* — Jialong He
(74) *Attorney, Agent, or Firm* — Jones Day

(57) ABSTRACT

Systems and methods are provided for a processor-implemented method of analyzing quality of sound acquired via a microphone. An input metric is extracted from a sound recording at each of a plurality of time intervals. The input metric is provided at each of the time intervals to a neural network that includes a memory component, where the neural network provides an output metric at each of the time intervals, where the output metric at a particular time interval is based on the input metric at a plurality of time intervals other than the particular time interval using the memory component of the neural network. The output metric is aggregated from each of the time intervals to generate a score indicative of the quality of the sound acquired via the microphone.

18 Claims, 7 Drawing Sheets

(56) References Cited

OTHER PUBLICATIONS

Yu, Zhou, et al. "Using bidirectional lstm recurrent neural networks to learn high-level abstractions of sequential features for automated scoring of non-native spontaneous speech." Automatic Speech Recognition and Understanding (ASRU), 2015 IEEE Workshop on. IEEE, Dec. 2015.*
Metallinou, Angeliki, and Jian Cheng. "Using deep neural networks to improve proficiency assessment for children English language learners."INTERSPEECH. 2014.*
Gonzalez-Dominguez, Javier, et al. "Automatic language identification using long short-term memory recurrent neural networks." Interspeech. 2014.*
Attali, Yigal, Burstein, Jill; Automated Essay Scoring with E-Rater, V.2; Journal of Technology, Learning, and Assessment, 4(3); 2006.
Bernstein, Jared, Cheng, Jian, Suzuki, Masanori; Fluency and Structural Complexity as Predictors of L2 Oral Proficiency; Proceedings of InterSpeech; pp. 1241-1244; 2010.
Bishop, Christopher; Pattern Recognition and Machine Learning; Singapore: Springer; 2006.
Chen, Lei, Zechner, Klaus; Applying Rhythm Features to Automatically Assess Non-Native Speech; Proceedings of Interspeech; 2011.
Chen, Lei, Zechner, Klaus, Xi, Xiaoming; Improved Pronunciation Features for Construct-Driven Assessment of Non-Native Spontaneous Speech; Proceedings of the North American Chapter of the ACL, Human Language Technologies; pp. 442-449; 2009.
Chen, Lei, Tetreault, Joel, Xi, Xiaoming; Towards Using Structural Events to Assess Non-Native Speech; Proceedings of the Naacl HLT 2010 Fifth Workshop on Innovative Use of NLP for Building Educational Applications; pp. 74-79; 2010.
Chen, Lei, Yoon, Su-Youn; Application of Structural Events Detected on ASR Outputs for Automated Speaking Assessment; Proceedings of INTERSPEECH; 2012.
Cucchiarini, Calla, Strik, Helmer, Boves, Lou; Quantitative Assessment of Second Language Learners' Fluency: Comparisons Between Read and Spontaneous Speech; Journal of the Acoustical Society of America, 111(6); pp. 2862-2873; 2002.
Eyben, Florian, Wollmer, Martin, Schuller, Bjorn; openSMILE—The Munich Versatile and Fast Open-Source Audio Feature Extractor; Proceedings of ACM Multimedia, 10; pp. 1459-1462; 2010.
Fan, Yuchen, Qian, Yao, Xie, Fenglong, Soong, Frank; TTS Synthesis with Bidirectional LSTM Based Recurrent Neural Networks; Proceedings of INTERSPEECH; pp. 1964-1968; Sep. 2014.
Franco, Horacio, Bratt, Harry, Rossier, Romain, Gade, Venkata Rao, Shriberg, Elizabeth, Abrash, Victor, Precoda, Kristin; EduSpeak: A Speech Recognition and Pronunciation Scoring Toolkit for Computer-Aided Language Learning Applications; Language Testing, 27(3); pp. 401-418; 2010.
Graves, Alex, Jaitly, Navdeep, Mohamed, Abdel-rahman; Hybrid Speech Recognition with Deep Bidirectional LSTM; Proceedings of the Automatic Speech Recognition and Understanding (ASRU), IEEE; pp. 273-278; 2013.
Graves, Alex; Supervised Sequence Labelling with Recurrent Neural Networks; Studies in Computational Intelligence, vol. 385; Springer-Verlag; 2012.
Graves, Alex, Schmidhuber, Jurgen; Framewise Phoneme Classification with Bidirectional Lstm and Other leural Network Architectures; Neural Networks, 18(5); pp. 602-610; 2005.
Higgins, Derrick; Xi, Xiaoming, Zechner, Klaus, Williamson, David; A Three-Stage Approach to the Automated Scoring of Spontaneous Spoken Responses; Computer Speech and Language, 25; pp. 282-306; 2011.
Hochreiter, Sepp, Schmidhuber, Jurgen; Long Short-Term Memory; Neural Computation, 9(8); pp. 1735-1780; 1997.
Krizhevsky, Alex, Sutskever, Ilya, Hinton, Geoffrey; ImageNet Classification with Deep Convolutional Neural Networks; Proceedings of the Advances in Neural Information Processing Systems; pp. 1097-1105; 2012.
Landauer, Thomas, Laham, Darrell, Foltz, Peter; Automated Scoring and Annotation of Essays with the Intelligent Essay Assessor; Ch. 6, In Automated Essay Scoring: A Cross-Disciplinary Perspective, M. Shermis and J. Burstein (Eds.); pp. 87-112; 2001.
Loukina, Anastassia, Zechner, Klaus, Chen, Lei, Heilman, Michael; Feature Selection for Automated Speech Scoring; Proceedings of the 10th Workshop on Innovative Use of NLP for Building Educational Applications; pp. 12-19; Jun. 2015.
Ngiam, Jiquan, Khosla, Aditya, Kim, Mingyu, Nam, Juhan, Lee, Honglak, NG, Andrew; Multimodal Deep Learning; Proceedings of the 28th International Conference on Machine Learning; pp. 689-696; 2011.
Pedregosa, Fabian, Varoquaux, Gael, Gramfort, Alexandre, Michel, Vincent, Thirion, Bertrand, Grisel, Olivier, Blondel, Mathieu, Prettenhofer, Peter, Weiss, Ron, Dubourg, Vincent, Vanderplas, Jake, Passos, Alexandre, Cournapeau, David, Brucher, Matthieu, Perrot, Matthieu, Duchesnay, Edouard; Scikit-learn: Machine Learning in Python; Journal of Machine Learning Research, 12; pp. 2825-2830; 2011.
Rumelhart, David; Hinton, Geoffrey, Williams, Ronald; Learning Internal Representations by Error Propagation; Institute for Cognitive Science, DTIC; Sep. 1985.
Schuster, Mike, Paliwal, Kuldip; Bidirectional Recurrent Neural Networks; IEEE Transactions on Signal Processing, 45(11); pp. 2673-2681; Nov. 1997.
Smola, Alex, Scholkopf, Bernhard; A Tutorial on Support Vector Regression; Statistics and Computing, 14(3); pp. 199-222; 2004.
Wang, Xinhao, Evanini, Keelan, Zechner, Klaus; Coherence Modeling for the Automated Assessment of Spontaneous Spoken Responses; Proceedings of the NAACL-HLT; pp. 814-819; Jun. 2013.
Wang, Zhen, Von Davier, Alina; Monitoring of Scoring Using the E-Rater Automated Scoring System and Human Raters on a Writing Test; Educational Testing Service, Research Report RR-14-04; Jun. 2014.
Yu, Zhou, Gerritsen, David, Ogan, Amy, Black, Alan, Cassell, Justine; Automatic Prediction of Friendship via Multi-Model Dyadic Features; Proceedings of the SIGDIAL 2013 Conference; pp. 51-60; Aug. 2013.
Zechner, Klaus, Higgings, Derrick, Xi, Xiaoming, Williamson, David; Automatic Scoring of Non-Native Spontaneous Speech in Tests of Spoken English; Speech Communication, 51(10); pp. 883-895; 2009.

* cited by examiner

| CATEGORY | QUANTITY | EXAMPLE FEATURES |
|---|---|---|
| FLUENCY | 19 | FEATURES BASED ON THE NUMBER OF WORDS PER SECOND, NUMBER OF WORDS PER CHUNK, NUMBER OF SILENCES, AVERAGE DURATION OF SILENCES, FREQUENCY OF LONG PAUSES (2':0.5 sec.), NUMBER OF FILLED PAUSES (uh AND um) [3]. |
| PITCH AND POWER | 11 | BASIC DESCRIPTIVE STATISTICS (MEAN, MINIMUM, MAXIMUM, RANGE, STANDARD DEVIATION) FOR THE PITCH AND POWER MEASUREMENTS FOR THE UTTERANCE. |
| RHYTHM, INTONATION AND STRESS | 12 | FEATURES BASED ON THE DISTRIBUTION OF PROSODIC EVENTS (PROMINCENCES AND BOUNDARY TONES) IN AN UTTERANCE AS DETECTED BY A STATISTICAL CLASSIFIER (OVERALL PERCENTAGES OF PROSODIC EVENTS, MEAN DISTANCE BETWEEN EVENTS, MEAN DEVIATION OF DISTANCE BETWEEN EVENTS) [3] AS WELL AS FEATURES BASED ON THE DISTRIBUTION OF VOWEL, CONSONANT, AND SYLLABLE DURATIONS (OVERALL PERCENTAGES, STANDARD DEVIATION, AND PAIRWISE VARIABILITY INDEX) [12]. |
| PRONUNCIATION | 11 | ACOUSTIC MODEL LIKELIHOOD SCORES, GENERATED DURING FORCED ALIGNMENT WITH A NATIVE SPEAKER ACOUISTIC MODEL, THE AVERAGE WORD-LEVEL CONFIDENCE SCORE OF ASR AND THE AVERAGE DIFFERENCE BETWEEN THE VOWEL DURATIONS IN THE UTTERANCE AND VOWEL-SPECIFIC MEANS BASED ON THE CORPUS OF NATIVE SPEECH [13]. |
| DISFLUENCIES | 6 | FREQUENCY OF BETWEEN-CLAUSE SILENCES AND EDIT DISFLUENCIES COMPARED TO WITHIN-CLAUSE SILENCES AND EDIT DISFLUENCIES [14, 15]. |
| GRAMMAR | 12 | SIMILARITY SCORES OF THE GRAMMAR OF THE RESPONSE IN ASR WITH RESPECT TO REFERENCE RESPONSE. |
| VOCABULARY USE | 13 | FEATURES ABOUT HOW DIVERSE AND SOPHISTICATED THE VOCABULARY BASED ON THE ASR OUTPUT. |
| ITEM META INFO | 7 | THE LENGTH OF RESPONSE IN SECONDS, TEST TAKER'S GENDER, TEST LOCATION, NATIVE COUNTRY AND NATIVE LANGUAGE, RESPONSE TYPE, WHICH IS INDEPENDENT OR DEPENDENT, AND THE INDEX OF THE RESPONSE. |

*Fig. 3*

PROCESSOR-IMPLEMENTED SYSTEMS AND METHODS FOR DETERMINING SOUND QUALITY

CROSS-REFERENCE TO RELATED APPLICATIONS

This application claims priority to U.S. Provisional Application No. 62/195,359, filed Jul. 22, 2015, the entirety of which is herein incorporated by reference.

BACKGROUND

It is often important to measure the quality of input data for a variety of reasons. For example, it can be beneficial to determine a quality of certain sound acquired in a system so that feedback can be provided to the source of that sound. That feedback can enable improvement of the sound at the source, enabling better communication of information in the future. Traditionally, such physical data extraction and analysis has utilized time-aggregated features (e.g., mean length of silence periods) to characterize the quality of the input data. Such, systems fail to take advantage of contextual information that can be acquired by looking at data, not only as a whole, but at individual segments within the data, in view of what has happened before and after those individual segments.

SUMMARY

Systems and methods are provided for a processor-implemented method of analyzing quality of sound acquired via a microphone. An input metric is extracted from a sound recording at each of a plurality of time intervals. The input metric is provided at each of the time intervals to a neural network that includes a memory component, where the neural network provides an output metric at each of the time intervals, where the output metric at a particular time interval is based on the input metric at a plurality of time intervals other than the particular time interval using the memory component of the neural network. The output metric is aggregated from each of the time intervals to generate a score indicative of the quality of the sound acquired via the microphone.

As another example, a processor-implemented system for analyzing quality of sound acquired via a microphone includes a processing system comprising one or more data processors and a non-transitory computer-readable medium encoded with instructions for commanding the processing system to execute steps of a method. In the method, an input metric is extracted from a sound recording at each of a plurality of time intervals. The input metric is provided at each of the time intervals to a neural network that includes a memory component, where the neural network provides an output metric at each of the time intervals, where the output metric at a particular time interval is based on the input metric at a plurality of time intervals other than the particular time interval using the memory component of the neural network. The output metric is aggregated from each of the time intervals to generate a score indicative of the quality of the sound acquired via the microphone.

As a further example, a non-transitory computer-readable medium is encoded with instructions for commanding one or more data processors to execute steps of a method of analyzing quality of sound acquired via a microphone. In the steps, an input metric is extracted from a sound recording at each of a plurality of time intervals. The input metric is provided at each of the time intervals to a neural network that includes a memory component, where the neural network provides an output metric at each of the time intervals, where the output metric at a particular time interval is based on the input metric at a plurality of time intervals other than the particular time interval using the memory component of the neural network. The output metric is aggregated from each of the time intervals to generate a score indicative of the quality of the sound acquired via the microphone.

DESCRIPTION OF DRAWINGS

FIG. 3 is a diagram depicting example time aggregated features that can be used by a model in generating a sound quality score.

DETAILED DESCRIPTION

Figure 1:
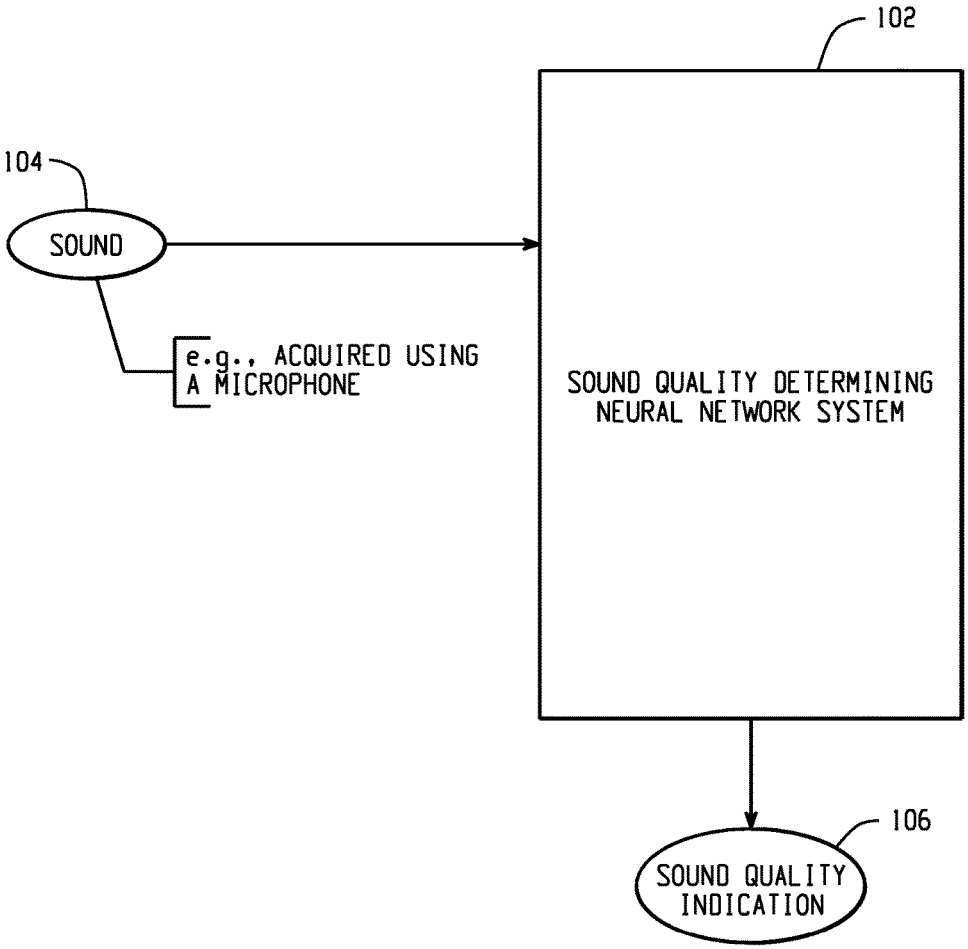
FIG. 1 is a diagram depicting a processor-implemented system for analyzing quality of sound acquired via a microphone.

FIG. 1 is a diagram depicting a processor-implemented system for analyzing quality of sound acquired via a microphone. In the example of FIG. 1, a sound quality determining neural network system 102 receives sound data 104, such as digital or analog sound data 104 acquired using a microphone. The system 102 provides that sound data 104 or data derived from that sound data to one or more neural networks that have memory capability, such that those neural networks can provide output that not only considers current sound data input, but also sound data input from the past, and in some instances in the future. The system 102 utilizes output of the one or more neural networks to generate a sound quality indication 106 that is output from the system 102.

Figure 2:
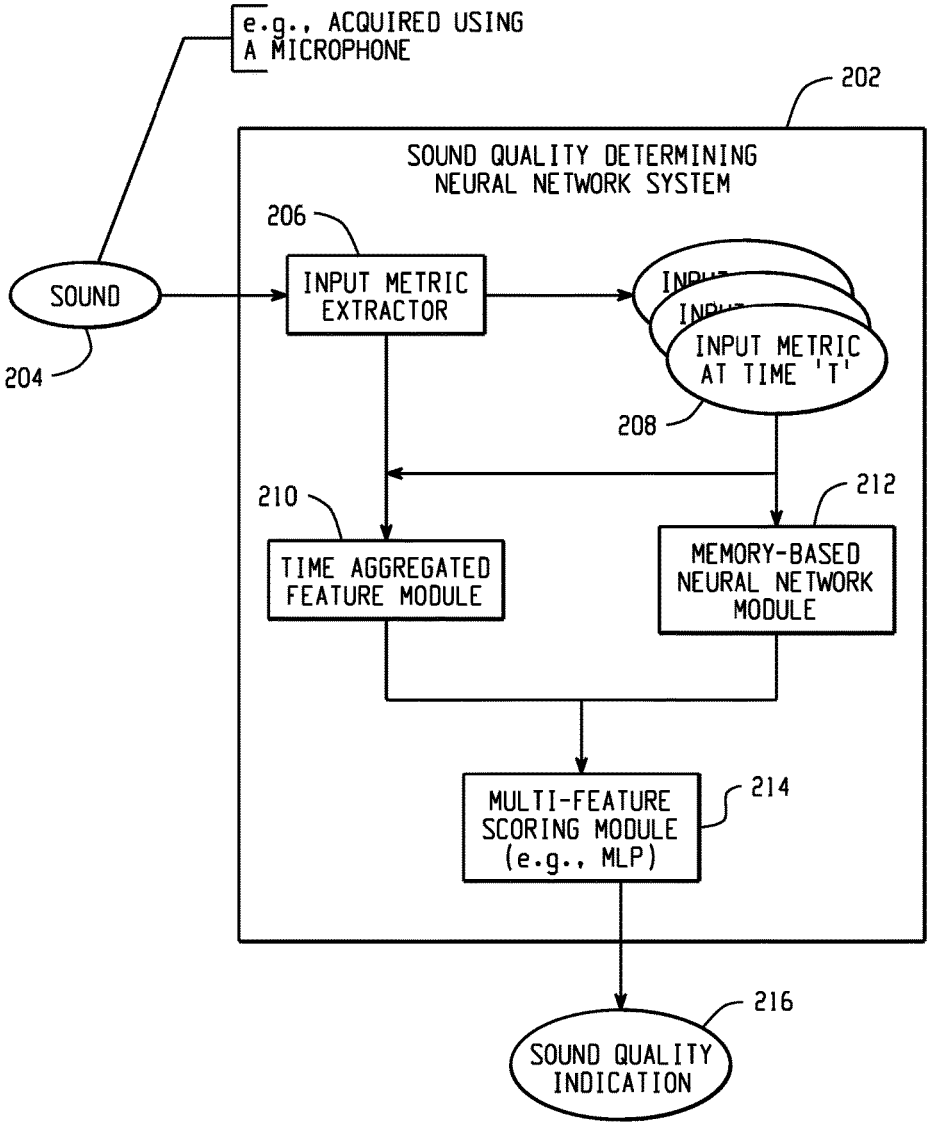
FIG. 2 is a diagram depicting example components of a sound quality determining neural network system.

FIG. 2 is a diagram depicting example components of a sound quality determining neural network system. In the example of FIG. 2, the system 202 receives sound data 204 acquired via a microphone. An input metric extractor 206 is configured to extract an input metric 208 from the sound data 204 (e.g., a digital or analog sound recording), at each of a plurality of time intervals (e.g., times T−2, T−1, T, T+1, T+2 . . . ) of a particular length (e.g., 0.1 s, 0.5 s, 1 s, 5 s, 10 s, 30 s). Some data from the input metric extractor 206 is provided to a time aggregated feature model 210, which computes features associated with the sound data 204 based on all or substantial portions of time of the sound data (e.g., a metric indicating the mean length of pauses in the sound data 204). The data received by the time aggregated feature module 210 may be the same time interval data depicted at 208 or may be other data from the input metric extractor 206. Additionally, a memory based neural network model 212 receives the input metric 208 at each of the time intervals and is configured to output data at one or more (e.g., each) of the time intervals. The memory-based neural network module 212 includes a memory component, such that it can output feature data for a particular time interval based on input data 208 for time intervals other than the particular time interval (e.g., past time interval data or future time interval data). A multi-feature scoring module 214 receives feature data from the time aggregated feature module 210 and the memory-based neural network module 212 (e.g., feature data at each time interval) and uses that data to generate a sound quality indication 216. In one embodiment, the multi-feature scoring module 214 is implemented as a multilayer perceptron (MLP) or alinear regression (LR) module.

A sound quality determining neural network system can be implemented in a variety of contexts. For example, such a system can be utilized in a system configured to automatically (e.g., without any human input on speech quality) analyze the quality of spontaneous speech (e.g., non-native spontaneous speech spoken as part of a learning exercise or evaluation). Receptive language skills, i.e., reading and listening, are typically assessed using a multiple-choice paradigm, while productive skills, i.e., writing and speaking, usually are assessed by eliciting constructed responses from the test taker. Constructed responses are written or spoken samples such as essays or spoken utterances in response to certain prompt and stimulus materials in a language test. Due to the complexity of the constructed responses, scoring has been traditionally performed by trained human raters, who follow a rubric that describes the characteristics of responses for each score point. However, there are a number of disadvantages associated with human scoring, including factors of time and cost, scheduling issues for large-scale assessments, rater consistency, rater bias, central tendency, etc.

Automated scoring provides a computerized system that mimics human scoring, but in the context of a computer system that inherently operates much differently from a human brain, which makes such evaluations effortlessly. The processes described herein approach automated scoring problems in a significantly different manner than a human would evaluate the same problem, even though the starting and ending points are sometimes the same. The systems and methods described herein are directed to a problem that is uniquely in the computer realm, where a system is sought that can mimic the behavior of a human scoring, using a computer-processing system that functions much differently than a human brain.

Many state-of-the art automated speech scoring systems leverage an automatic speech recognition (ASR) front-end system that provides word hypotheses about what the test taker said in his response. Training such a system requires a large corpus of non-native speech as well as manual transcriptions thereof. The outputs of this ASR front-end are then used to design further features (lexical, prosodic, semantic, etc.) specifically for automatic speech assessment, which are then fed into a machine-learning-based scoring model. Certain embodiments herein reduce or eliminate the need for one or more of these actions.

In one embodiment, a Bidirectional Long Short Term Memory Recurrent Neural Networks (BLSTM) is used to combine different features for scoring spoken constructed responses. The use of BLSTMs enables capture of information regarding the spatiotemporal structure of the input spoken response time series. In addition, by using a bidirectional optimization process, both past and future context are integrated into the model. Further, by combining higher-level abstractions obtained from the BLSTM model with time aggregated response-level features, a system provides an automated scoring system that can utilize both time sequence and time aggregated information from speech.

For example, a system can combine fine-grained, time aggregated features at a level of the entire response that capture pronunciation, grammar, etc. (e.g., that a system like the SpeechRater system can produce) with time sequence features that capture frame-by-frame information regarding prosody, phoneme content, and speaker voice quality of the input speech. An example system uses a BLSTM with either a multilayer perceptron (MLP) or a linear regression (LR) based output layer to jointly optimize the automated scoring model.

As noted above, a system can provide a quality score based in part on time aggregated features. In one example, SpeechRater extracts a range of features related to several aspects of the speaking construct. These include pronunciation, fluency, intonation, rhythm, vocabulary use, and grammar. A selection of 91 of these features was used to score spontaneous speech. FIG. 3 is a diagram depicting example time aggregated features that can be used by a model in generating a sound quality score. This set of 91 features is referred to herein as the content feature set. Within the content feature set, there is a subset of features that only consist of meta information, such as the length of the audio file, the gender of the test taker, etc. This set of seven features is referred to as the meta-feature set.

In addition to the time aggregated features discussed above, one or more time sequence features are generated that utilize one or more neural networks having memory capabilities. The time-aggregated features computed from the input spoken response take into account delivery, prosody, lexical and grammatical information. Among these, features such as the number of silences capture aggregated information over time. However, some pauses might be more salient than others for purposes of scoring—for instance, silent pauses that occur at clause boundaries in particular are highly correlated with language proficiency grading. In addition, time aggregated features do not fully consider the evolution of the response over time. Thus systems and methods described herein utilize time-sequence features that capture the evolution of information over time and use machine learning methods to discover structure patterns in this information stream. In one example, a system extracts six prosodic features—"Loudness," "F0," "Voicing," "Jitter Local," "Jitter DDP," and "Shimmer Lo-cal." "Loudness" captures the loudness of speech, i.e., the normalized intensity. "F0" is the smoothed fundamental frequency contour. "Voicing" stands for the voicing probability of the final fundamental frequency candidate, which captures the breathy level of the speech. "Jitter Local" and "Jitter DDP" are measures of the frame-to-frame jitter, which is defined as the deviation in pitch period length, and the differential frame-to-frame jitter, respectively. "Shimmer Local" is the frame-to-frame shimmer, which is defined as the amplitude deviation between pitch periods.

Apart from prosodic features, in certain examples a group of "Mel-Frequency Cepstrum Coefficients" (MFCC's) are extracted from 26 filter-bank channels. MFCC's capture an overall timbre parameter which measures both what is said (phones) and the specifics of the speaker voice quality, which provides more speech information apart from the prosodic features described above. MFCCs are computed, in one example, using a frame size of 25 ms and a frame shift size of 10 ms, based on the configuration file parameters. MFCC features can be useful in phoneme classification, speech recognition, or higher level multimodal social signal processing tasks.

An LSTM architecture can include of a set of recurrently connected subnets, known as memory blocks. Each block contains one or more self-connected memory cells and three multiplicative units—the input, output and forget gates— that provide continuous analogues of write, read and reset operations for the cells. An LSTM network is formed, in one example like a simple RNN, except that the nonlinear units in the hidden layers are replaced by memory blocks.

The multiplicative gates allow LSTM memory cells to store and access information over long periods of time, thereby avoiding the vanishing gradient problem. For example, as long as the input gate remains closed (i.e. has an activation close to 0), the activation of the cell will not be overwritten by the new inputs arriving in the network, and can therefore be made available to the net much later in the sequence, by opening the output gate.

Figure 4:
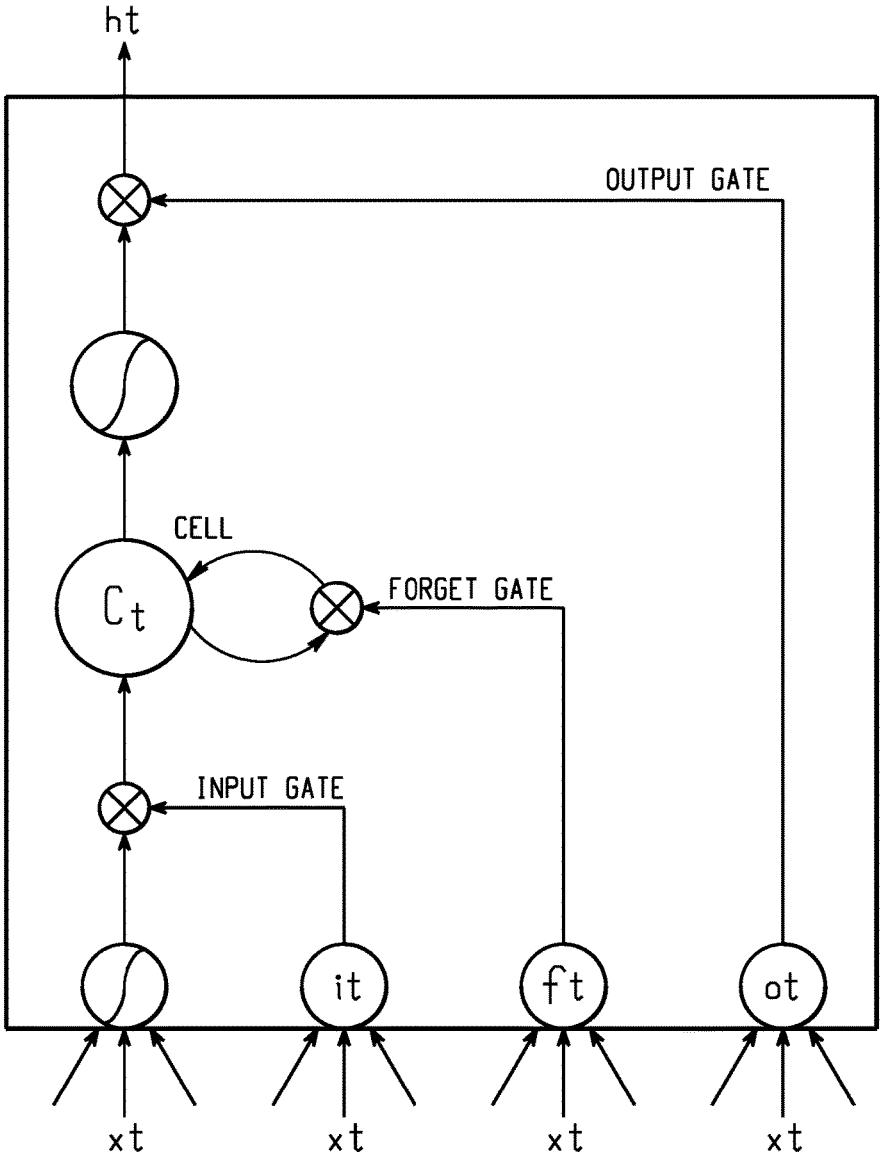
FIG. 4 is a diagram depicting a single LSTM memory cell.

Given an input sequence $x=(x_1, \ldots, x_T)$, a standard recurrent neural network (RNN) computes the hidden vector sequence $h=(h_1, \ldots, h_T)$ and output vector sequence $y=(y_1, \ldots, y_T)$ by iterating the following equations from t=1 to T:

$$h_t=H(W_{xh}x_t+W_{hh}h_{t-1}+b_h)$$

$$y_t=W_{hy}h_t+b_0$$

where the W terms denote weight matrices (e.g. $W_{xh}$ is the input-hidden weight matrix), the b terms denote bias vectors (e.g. $b_h$ is the hidden bias vector) and His the hidden layer function. H is usually an element wise application of a sigmoid function. In some embodiments, the LSTM architecture, which uses custom-built memory cells to store information, is better at finding and exploiting long range context. FIG. 4 is a diagram depicting a single LSTM memory cell.

In one embodiment, His implemented as following.

$$i_t=\sigma(W_{xi}x_t+W_{hi}h_{t-1}+W_{ci}c_{t-1}+b_i)$$

$$f_t=\sigma(W_{xf}x_t+W_{hf}h_{t-1}+W_{cf}c_{t-1}+b_f)$$

$$c_t=f_tc_{t-1}+i_t \tan h(W_{xc}x_t+W_{hc}h_{t-1}+b_c)$$

$$o_t=\sigma(W_{xo}x_t+W_{ho}h_{t-1}+W_{co}c_t+b_o)$$

$$h_t=\sigma_t \tan h(c_t)$$

where σ is the logistic sigmoid function, and i, f, o, and c are respectively the input gate, forget gate, output gate and cell activation vectors, all of which are the same size as the hidden vector h. $W_{hi}$ is the hidden-input gate matrix, $W_{xo}$ is the input-output gate matrix. The weight matrix from the cell to gate vectors (e.g. $W_{ci}$) are diagonal, so element m in each gate vector only receives input from element m of the cell vector. The bias terms have been omitted in this example for clarity.

Bidirectional RNNs (BRNNs) utilize context by processing the data in both directions with two separate hidden layers, which are then fed forwards to the same output layer. A BRNN can compute the forward hidden sequence $\vec{h}$, the backward hidden sequence $\overleftarrow{h}$ and the output sequence y by iterating the backward layer from t=T to 1, the forward layer from t=1 to T and then updating the output layer:

$$\vec{h}=H(W_{x\vec{h}}x_t+W_{\vec{h}\vec{h}}\vec{h}_{t+1}+b_{\vec{h}})$$

$$\overleftarrow{h}=H(W_{x\overleftarrow{h}}x_t+W_{\overleftarrow{h}\overleftarrow{h}}\overleftarrow{h}_{t+1}+b_{\overleftarrow{h}})$$

$$y_t=W_{\vec{h}y}\vec{h}_t+W_{\overleftarrow{h}y}\overleftarrow{h}_t+b_y)$$

Combining BRNNs with LSTM gives bidirectional LSTM, which can access long-range context in both input directions. In automatic grading, where the whole responses are collected at once, future context and history context can be utilized together.

In one embodiment, two neural network architectures are used to generate a sound quality score: the multilayer perceptron (MLP) and the bidirectional long short term memory recurrent neural networks (BLSTM). A BLSTM is used to learn the high level abstraction of the time-sequence features and MLP/LR is used as the output layer to combine the hidden state outputs of a BLSTM with time-aggregated features. The BLSTM and the MLP/LR are optimized jointly.

Figure 5:
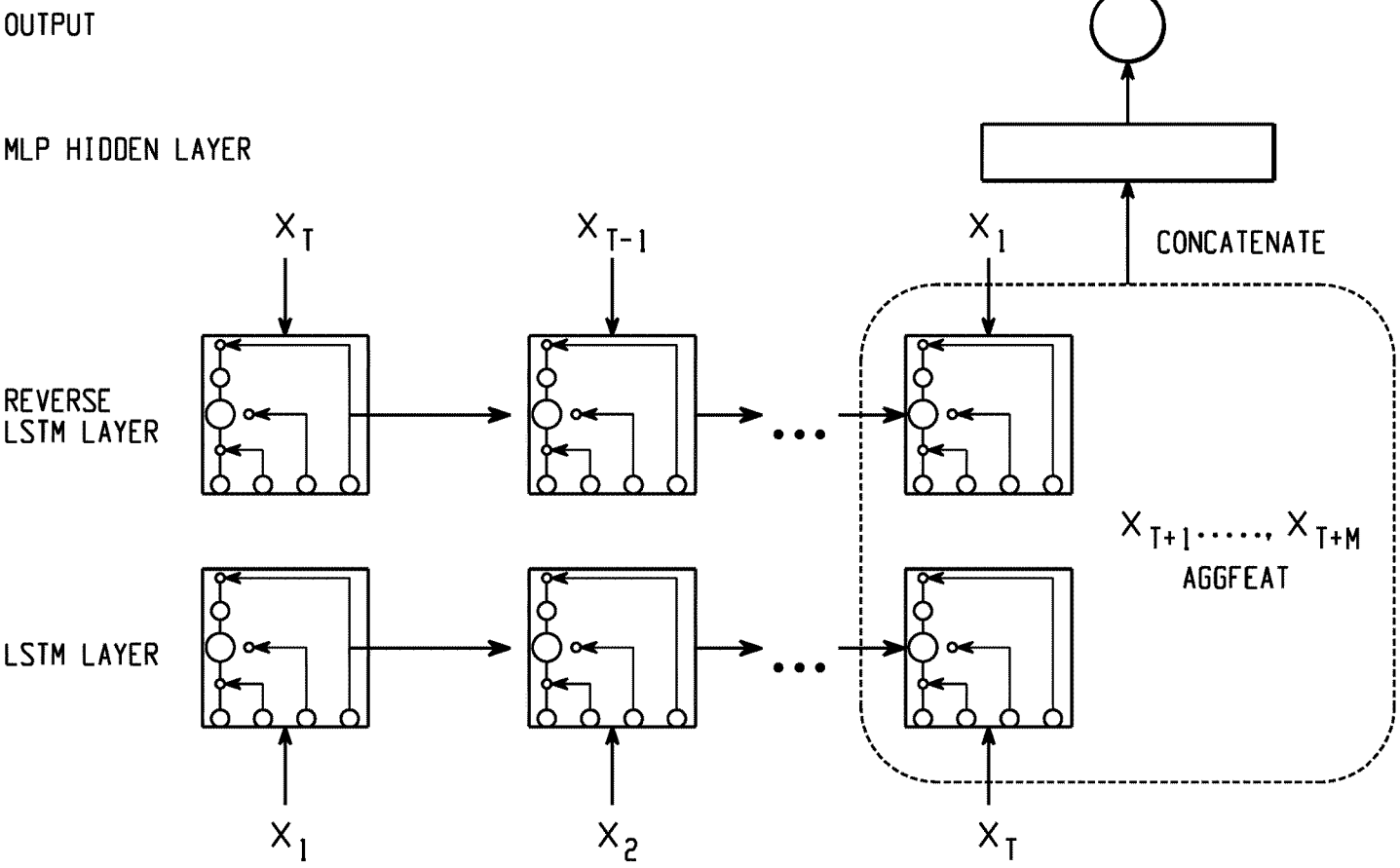
FIG. 5 is a diagram depicting an LSTM architecture with an MLP output layer.

FIG. 5 is a diagram depicting an LSTM architecture with an MLP output layer. In the example of FIG. 5, the time-sequence($[X_1, \ldots, X_T]$) and time aggregated features (AggFeat $[X_T, \ldots, X_{T+M}]$) are jointly optimized. Features depicted in the dotted square are concatenated during optimization. The system of FIG. 5 uses an MLP with one hidden layer; the input layer of the MLP consists of time-aggregated features. Then, the input layer is fully connected to the hidden layer, and the hidden layer is fully connected to an output layer. In one embodiment, standard logistic sigmoid is used as the activation function in the MLP.

With reference to the BLSTM, the input layer dimension of the BLSTM is the dimension of the time-sequence features. The input layer is fully connected to the hidden layer, and the hidden layer is fully connected to the output layer. LSTM blocks use the logistic sigmoid for the input and output squashing functions of the cell. The BLSTM can be augmented, in some embodiments, by concatenating the time aggregated features to the last hidden state output of the LSTM and reverse-LSTM. The example of FIG. 5 uses two types of regressors in the output layer: MLP and LR.

Neural network models, as described herein, can be implemented in a variety of configurations including: BLSTM with an MLP output layer; BLSTM with LR output layer, standalone MLP, BLSTM with an MLP output layer that utilizes prosodic and MFCC features as a time sequence feature set and a content feature set as a time aggregated feature set.

Figure 6A:
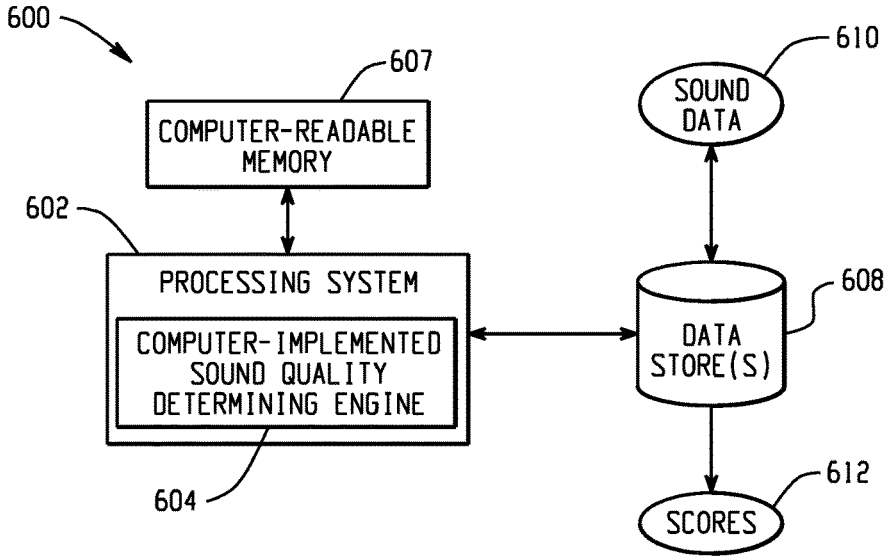
FIGS. 6A, 6B, and 6C depict example systems for implementing the approaches described herein for implementing a computer-implemented sound quality determining engine.
Figure 6B:
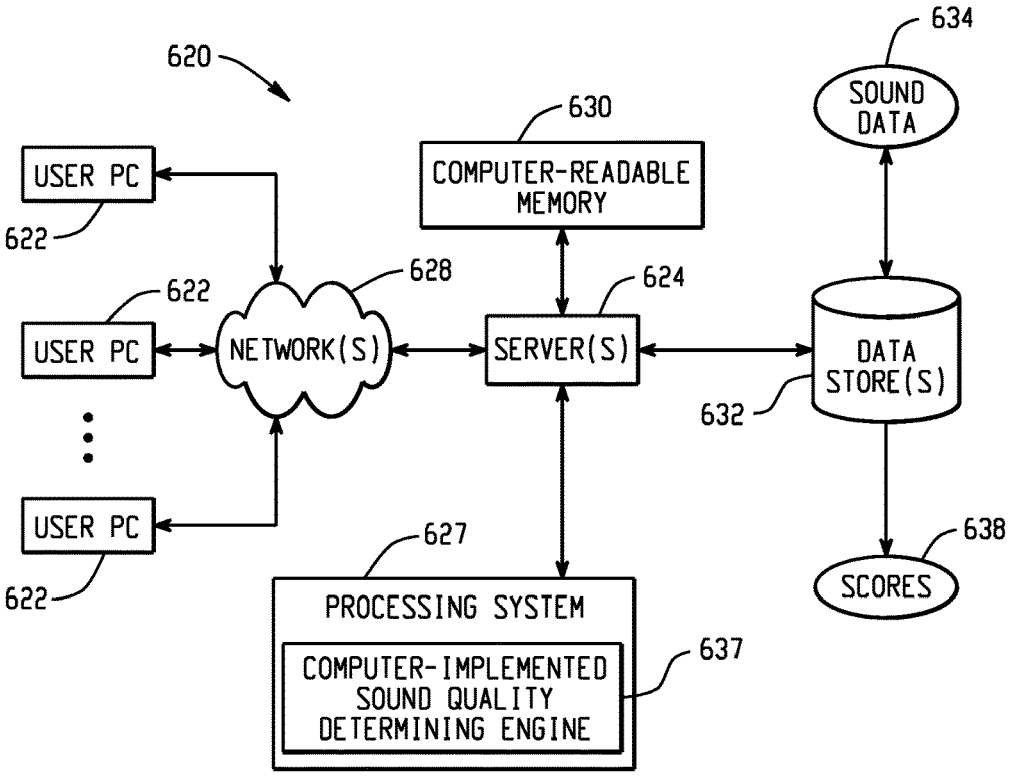
Figure 6C:
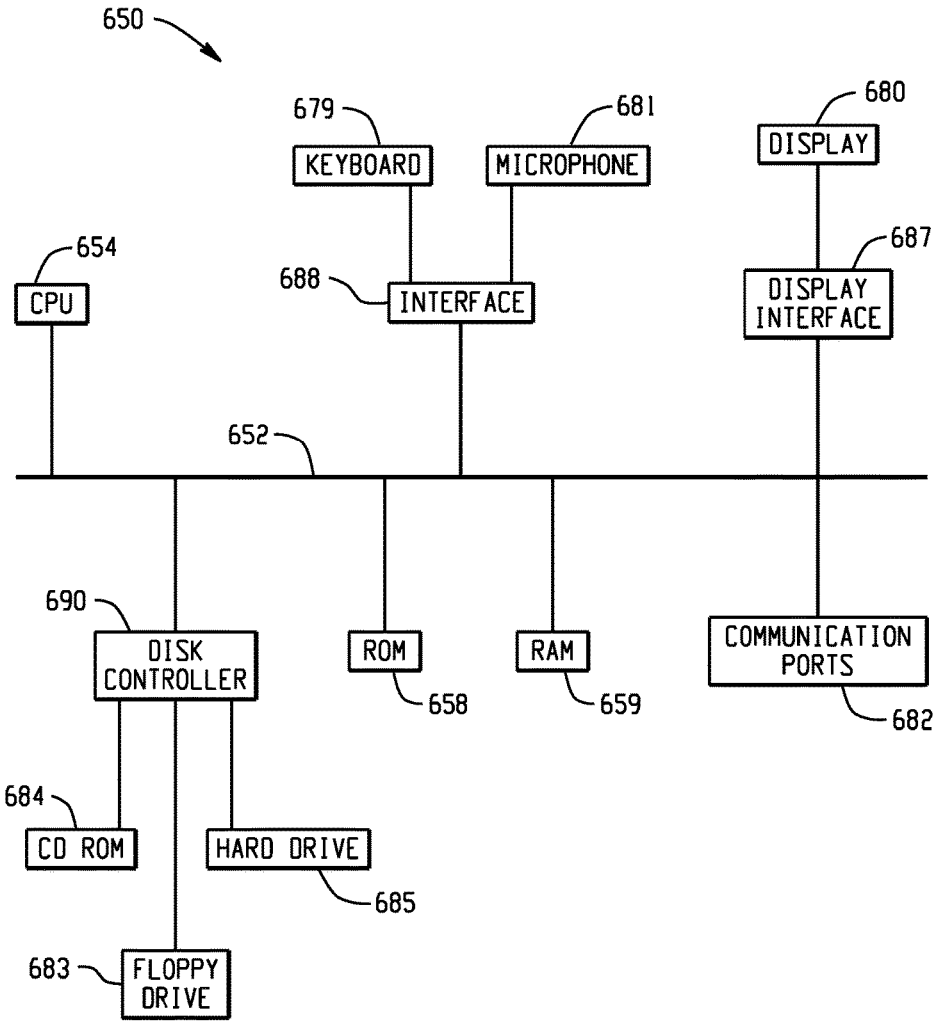

FIGS. 6A, 6B, and 6C depict example systems for implementing the approaches described herein for implementing a computer-implemented sound quality determining engine. For example, FIG. 6A depicts an exemplary system 600 that includes a standalone computer architecture where a processing system 602 (e.g., one or more computer processors located in a given computer or in multiple computers that may be separate and distinct from one another) includes a computer-implemented sound quality determining engine 604 being executed on the processing system 602. The processing system 602 has access to a computer-readable memory 607 in addition to one or more data stores 608. The one or more data stores 608 may include sound data 610 as well as scores 612. The processing system 602 may be a distributed parallel computing environment, which may be used to handle very large-scale data sets.

FIG. 6B depicts a system 620 that includes a client-server architecture. One or more user PCs 622 access one or more servers 624 running a computer-implemented sound quality determining engine 637 on a processing system 627 via one or more networks 628. The one or more servers 624 may access a computer-readable memory 630 as well as one or more data stores 632. The one or more data stores 632 may include sound data 634 as well as scores 638.

FIG. 6C shows a block diagram of exemplary hardware for a standalone computer architecture 650, such as the architecture depicted in FIG. 6A that may be used to include and/or implement the program instructions of system embodiments of the present disclosure. A bus 652 may serve as the information highway interconnecting the other illustrated components of the hardware. A processing system 654 labeled CPU (central processing unit) (e.g., one or more computer processors at a given computer or at multiple computers), may perform calculations and logic operations required to execute a program. A non-transitory processor-readable storage medium, such as read only memory (ROM) 658 and random access memory (RAM) 659, may be in communication with the processing system 654 and may include one or more programming instructions for performing the method of implementing a computer-implemented sound quality determining engine. Optionally, program instructions may be stored on a non-transitory computer-readable storage medium such as a magnetic disk, optical disk, recordable memory device, flash memory, or other physical storage medium.

In FIGS. 6A, 6B, and 6C, computer readable memories 608, 630, 658, 659 or data stores 608, 632, 683, 684, 688 may include one or more data structures for storing and associating various data used in the example systems for implementing a computer-implemented sound quality determining engine. For example, a data structure stored in any of the aforementioned locations may be used to store data from XML files, initial parameters, and/or data for other variables described herein. A disk controller 690 interfaces one or more optional disk drives to the system bus 652. These disk drives may be external or internal floppy disk drives such as 683, external or internal CD-ROM, CD-R, CD-RW or DVD drives such as 684, or external or internal hard drives 685. As indicated previously, these various disk drives and disk controllers are optional devices.

Each of the element managers, real-time data buffer, conveyors, file input processor, database index shared access memory loader, reference data buffer and data managers may include a software application stored in one or more of the disk drives connected to the disk controller 690, the ROM 658 and/or the RAM 659. The processor 654 may access one or more components as required.

A display interface 687 may permit information from the bus 652 to be displayed on a display 680 in audio, graphic, or alphanumeric format. Communication with external devices may optionally occur using various communication ports 682.

In addition to these computer-type components, the hardware may also include data input devices, such as a keyboard 679, or other input device 681, such as a microphone, remote control, pointer, mouse and/or joystick.

Additionally, the methods and systems described herein may be implemented on many different types of processing devices by program code comprising program instructions that are executable by the device processing subsystem. The software program instructions may include source code, object code, machine code, or any other stored data that is operable to cause a processing system to perform the methods and operations described herein and may be provided in any suitable language such as C, C++, JAVA, for example, or any other suitable programming language. Other implementations may also be used, however, such as firmware or even appropriately designed hardware (e.g., ASICs, FPGAs) configured to carry out the methods and systems described herein.

The systems' and methods' data (e.g., associations, mappings, data input, data output, intermediate data results, final data results, etc.) may be stored and implemented in one or more different types of computer-implemented data stores, such as different types of storage devices and programming constructs (e.g., RAM, ROM, Flash memory, flat files, databases, programming data structures, programming variables, IF-THEN (or similar type) statement constructs, etc.). It is noted that data structures describe formats for use in organizing and storing data in databases, programs, memory, or other computer-readable media for use by a computer program.

The computer components, software modules, functions, data stores and data structures described herein may be connected directly or indirectly to each other in order to allow the flow of data needed for their operations. It is also noted that a module or processor includes but is not limited to a unit of code that performs a software operation, and can be implemented for example as a subroutine unit of code, or as a software function unit of code, or as an object (as in an object-oriented paradigm), or as an applet, or in a computer script language, or as another type of computer code. The software components and/or functionality may be located on a single computer or distributed across multiple computers depending upon the situation at hand.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." In addition, use of the term "based on," above and in the claims is intended to mean, "based at least in part on," such that an unrecited feature or element is also permissible.

While the disclosure has been described in detail and with reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. A processor-implemented method of analyzing quality of sound acquired via a microphone, comprising:

extracting an input metric from a sound recording at each of a plurality of time intervals;

providing the input metric at each of the time intervals to a memory based neural network, wherein the memory based neural network provides an output metric at each of the time intervals to a multilayer perceptron, wherein the output metric at a particular time interval is based on the input metric at a plurality of time intervals using the memory based neural network;

capturing, with the memory based neural network, information regarding a spatiotemporal structure of the input metric;

deriving a time aggregated sound quality feature using a time aggregated feature module;

generating, by the multilayer perceptron based on the time aggregated sound quality feature and the output metric, a score indicative of the quality of the sound acquired via the microphone, wherein the plurality of time intervals comprises at least one past time interval or at least one future time interval.

2. The method of claim 1, wherein the output metric at the particular time interval is based on input metric values at one or more past time intervals.

3. The method of claim 1, wherein the output metric at the particular time interval is further based on input metric values at one or more future time intervals.

4. The method of claim 1, wherein the output metric at the particular time interval is based on additional input metric values at time intervals other than the particular time interval.

5. The method of claim 1, wherein the output metric is a loudness metric that is based on a normalized intensity of the input data over the plurality of time intervals.

6. The method of claim 1, wherein the output metric is a fundamental frequency metric that is based on a smoothed fundamental frequency contour based on input data over the plurality of time intervals.

7. The method of claim 1, wherein the output metric is a voicing metric that is based on a voicing probability of a final fundamental frequency candidate over the plurality of time intervals.

8. The method of claim 1, wherein the output metric is a jitter metric that measures frame to frame jitter over the plurality of time intervals.

9. The method of claim 8, wherein frame to frame jitter is determined as a deviation in pitch period length or a differential frame to frame jitter.

10. The method of claim 1, wherein the output metric is a shimmer metric that is calculated based on an amplitude deviation across a plurality of pitch periods based on the plurality of time intervals.

11. The method of claim 1, wherein output metric is based on a timbre parameter measured across the plurality of time intervals.

12. The method of claim 1, wherein the score is indicative of a quality of spontaneous speech provided by an examinee, wherein the score is generated without determining a content of the spontaneous speech.

13. The method of claim 1, wherein the time-aggregated sound quality feature is a mean length of pauses metric.

14. A processor-implemented system for analyzing quality of sound acquired via a microphone, comprising:

a processing system comprising one or more data processors;

a non-transitory computer-readable medium encoded with instructions for commanding the processing system to execute steps of a method, the steps comprising:

extracting an input metric from a sound recording at each of a plurality of time intervals;

providing the input metric at each of the time intervals to a memory based neural network, wherein the memory based neural network provides an output metric at each of the time intervals to a multilayer perceptron, wherein the output metric at a particular time interval is based on the input metric at a plurality of time intervals using the memory based neural network;

capturing, with the memory based neural network, information regarding a spatiotemporal structure of the input metric;

deriving a time aggregated sound quality feature using a time aggregated feature module; and generating, by the multilayer perceptron based on the time aggregated sound quality feature and the output metric, a score indicative of the quality of the sound acquired via the microphone, wherein the plurality of time intervals comprises at least one past time interval or at least one future time interval.

15. The system of claim 14, wherein the output metric at the particular time interval is based on input metric values at one or more past time intervals.

16. The system of claim 14, wherein the output metric at the particular time interval is further based on input metric values at one or more future time intervals.

17. The system of claim 14, wherein the output metric at the particular time interval is based on additional input metric values at time intervals other than the particular time interval.

18. A non-transitory computer-readable medium encoded with instructions for commanding one or more data processors to execute steps of a method of analyzing quality of sound acquired via a microphone, the steps comprising:

extracting an input metric from a sound recording at each of a plurality of time intervals;

providing the input metric at each of the time intervals to a memory based neural network, wherein the memory based neural network provides an output metric at each of the time intervals to a multilayer perceptron, wherein the output metric at a particular time interval is based on the input metric at a plurality of time intervals using the memory based neural network;

capturing, with the memory based neural network, information regarding a spatiotemporal structure of the input metric;

deriving a time aggregated sound quality feature using a time aggregated feature module; and generating, by the multilayer perceptron based on the time aggregated sound quality feature and the output metric, a score indicative of the quality of the sound acquired via the microphone, wherein the plurality of time intervals comprises at least one past time interval or at least one future time interval.

* * * * *